10/15/85 OR 4,546,583

United States Patent [19]

Hussar

[11] Patent Number: 4,546,583

[45] Date of Patent: Oct. 15, 1985

[54] MODULAR BUILDING CONSTRUCTION SYSTEM

[76] Inventor: Gary Hussar, 20500 Kaiser Rd., Gregory, Mich. 48137

[21] Appl. No.: 558,377

[22] Filed: Dec. 5, 1983

[51] Int. Cl.[4] ..... E04H 9/06

[52] U.S. Cl. ..... 52/236.1; 52/79.3; 52/587

[58] Field of Search ..... 52/79.4, 79.9, 79.13, 52/79.3, 79.2, 236.1, 236.2, 236.6, DIG. 10, 587

[56] References Cited

U.S. PATENT DOCUMENTS

| | | | |
|---|---|---|---|
| 938,458 | 11/1909 | Brockhausen | 52/587 X |
| 1,425,114 | 8/1922 | Luard | 52/236.1 X |
| 1,425,117 | 8/1922 | Lynde | 52/236.1 X |
| 1,425,119 | 8/1922 | Lynde | 52/236.1 |
| 2,136,346 | 11/1938 | Wadman . | |
| 2,497,887 | 2/1950 | Hilpert . | |
| 2,545,046 | 3/1951 | Rownd . | |
| 2,918,992 | 12/1959 | Gelsavage . | |
| 2,922,299 | 1/1960 | Deam . | |
| 2,927,452 | 3/1960 | Heidenstam | 52/236.1 X |
| 2,942,115 | 6/1960 | O'Connell . | |
| 3,010,888 | 11/1961 | Battle . | |
| 3,152,366 | 10/1964 | McCory et al. | 52/236.1 X |
| 3,206,373 | 9/1965 | Dupuy . | |
| 3,494,092 | 2/1970 | Johnson et al. . | |
| 3,602,111 | 8/1971 | Clemente . | |
| 3,785,095 | 1/1974 | Verner . | |
| 3,854,256 | 12/1974 | Wilce . | |
| 3,951,085 | 4/1976 | Johnson et al. . | |
| 3,996,715 | 12/1976 | Dowse . | |
| 4,008,932 | 2/1977 | Wildschut . | |
| 4,228,623 | 10/1980 | Menosso | 52/587 X |

*Primary Examiner*—Donald G. Kelly
*Assistant Examiner*—Richard E. Chilcot, Jr.
*Attorney, Agent, or Firm*—Harness, Dickey & Pierce

[57] ABSTRACT

A modular building construction system that utilizes hexagonal-shaped floor and ceiling members and rectangular wall members. Window and door type openings may be provided in the wall members of each six-sided room thus formed within the structural integrity limits of the system members. The hexagonal shape of the floor and ceiling members provides an interlocking effect between adjacent floor and ceiling members that results in increased resistance to lateral forces as compared to standard rectangular floor patterns in conventional modular building constructions.

8 Claims, 7 Drawing Figures

FIG. 1.
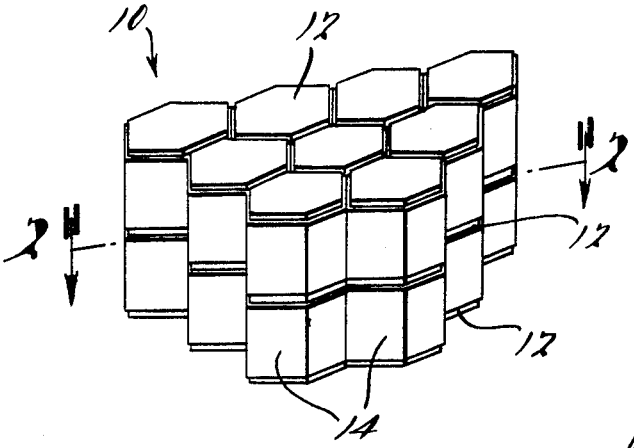
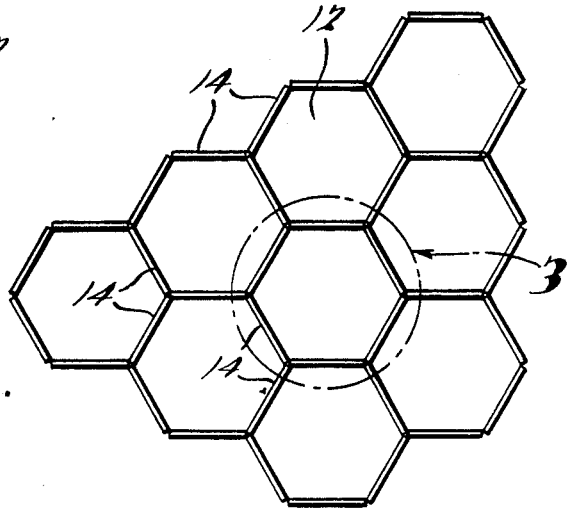
FIG. 2.
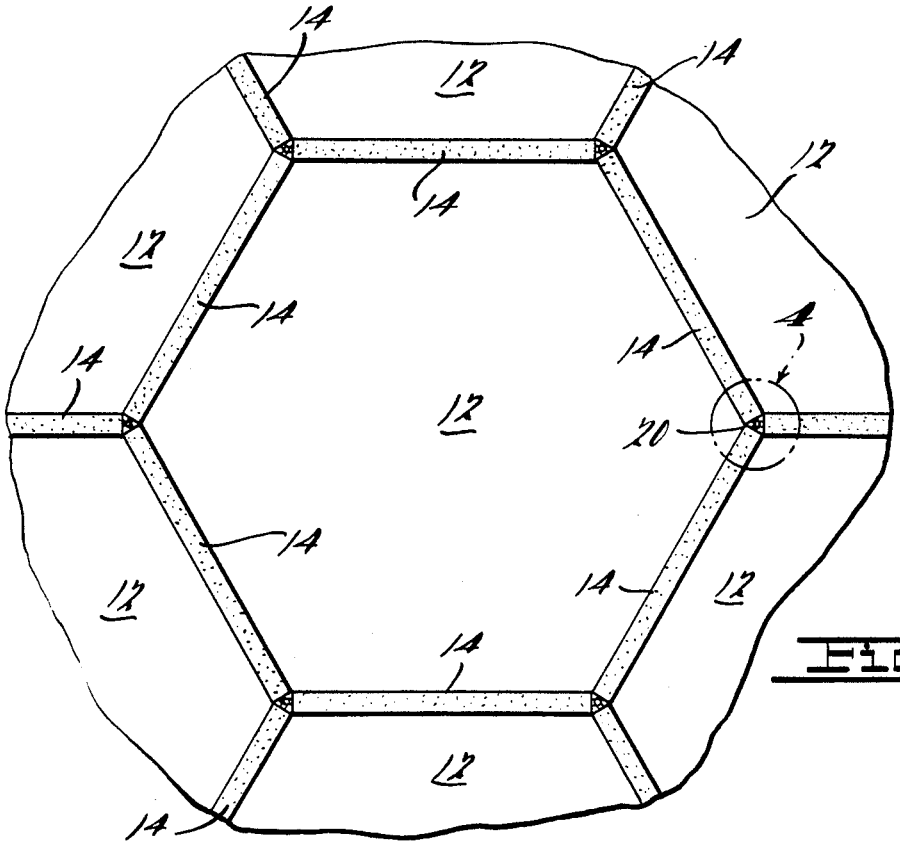
FIG. 3.

MODULAR BUILDING CONSTRUCTION SYSTEM

BACKGROUND AND SUMMARY OF THE INVENTION

The present invention relates generally to concrete building construction, and more particularly, to a modular structural system for constructing buildings that utilizes hexagonal-shaped floor and ceiling members and rectangular wall members. A plurality of the hexagonal floor members may be laid side by side in a nesting relationship with a plurality of wall members and corresponding ceiling members completing a multiple room structure. The system can be expanded to provide any reasonable number of hexagonal-shaped rooms per floor and is capable of having additional stories. Architectural features such as surface texture, window and door openings and the like can be included within the structural integrity limits of the members. The floor, ceiling and wall members may be fabricated from conventionally reinforced concrete and can be either site or shop cast.

The structural floor, ceiling and wall members have protruding hairpin or U-shaped reinforcing bars cast in their edges so that adjacent members may be structurally tied together by inserting a bar through the protruding loops that overlap. The inserted bar is grouted in place along with the loops to complete the structure.

The modular construction system of the present invention enables buildings to be constructed using a small number of standardized component parts. The fabricating of these parts requires the use of fewer forms than for conventional multi-level, multi-room buildings. The hexagonal shape of the individual rooms, as opposed to standard rectangular floor patterns, also gives the finished structure improved lateral stability and lessens the danger of progressive collapse. The hexagonal shape also inherently provides an interlocking effect between the nested floor members that results in improved resistance to lateral forces as compared to standard rectangular floor patterns in conventional modular systems. This improved resistance to lateral forces very closely approximates the horizontal rigidity of a monolithic structure.

The hexagonal shape provides greater resistance to lateral forces since, due to the interlocking nature of the hexagonal slabs, such forces are typically spread throughout a greater horizontal floor area than in rectangular precast construction systems. The hexagonal shape also converts lateral forces into axial forces on all the wall members and distributes such forces by repeatedly splitting such forces due to the discontinuous nature of the lines of connection between adjacent floor members and contiguous walls.

The unique construction system of the present invention provides a modular construction system for mass producing buildings with improved structural strength over conventionally known modular systems due to the interlocking hexagonal nature of adjacent floor and ceiling members. These buildings are mass produced at a reduced cost while obtaining structures of uniform construction and superior integrity. The reduced cost inures from the use of two simple standardized components, i.e. hexagonal floor and ceiling members, and rectangular wall members whose length corresponds to the sides of the hexagonal floor and ceiling members.

The above and other features of the invention will become apparent from a reading of the detailed description of the preferred embodiments, which make reference to the following set of drawings.

BRIEF DESCRIPTION OF THE DRAWINGS

FIG. 1 is an axonometric projection of a two story, multi-room building constructed with the modular building construction system of the present invention.

FIG. 2 is a sectional view taken along the line 2—2 of FIG. 1, showing a floor plan utilizing the hexagonal-shaped floor members and rectangular wall members of the present invention.

FIG. 3 is an enlarged view of the area designated with the numeral "3" in FIG. 2.

DETAILED DESCRIPTION OF THE PREFERRED EMBODIMENTS

Figure 4:
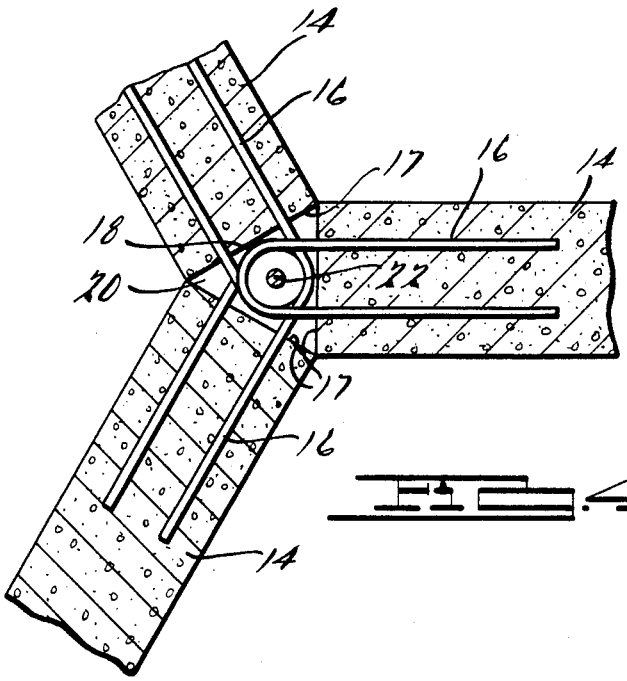
FIG. 4 is an enlarged view of the area designated with the numeral "4" in FIG. 3 showing an embodiment of the present invention in which three wall members are tied together at a line of connection.

Referring now to the drawings, a building constructed in accordance with the present invention is shown in FIGS. 1 at 10. The building 10 is generally constructed of a plurality of two basic standardized structural members, a hexagonal member 12 and a rectangular wall member 14. The hexagonal member 12 may serve as either a floor or ceiling member, or, in the case of multi-level buildings as at 10, the hexagonal members 12 may also serve as both a floor and ceiling member.

The hexagonal members 12 and wall members 14 are made in the preferred embodiment of precast conventionally reinforced concrete and may be fabricated on site or in a shop. Other types of concrete or suitable construction materials may also be used in the modular construction system such as prestressed steel or other metal and the like.

The hexagonal members 12 are adjacently laid in a nesting or interlocking relationship in accordance with a desired floor plan as shown in FIG. 2. The length of the wall members 14 correspond to the length of the sides of the hexagonal members 12 which may be altered to suit various conditions. When the sides of two hexagonal members are adjacent, as depicted in FIG. 2, a single wall member 14 may rest on the adjacent side edges of both hexagonal members 12 and serve as an interior wall for each of the adjacent hexagonal rooms. As is readily apparent from FIGS. 1 and 2, the hexagonal modular construction system of the present invention can be expanded to provide any reasonable number of rooms per floor and is capable of having additional stories. The hexagonal members 12 and the wall members 14 are fabricated in accordance with local building code requirements with respect to concrete reinforcement, concrete thickness, specified concrete strength, and the like. Architectural features such as window and door openings and surface treatment may all be included within the structural integrity limits of the hexagonal members 12 and the wall members 14.

Figure 5:
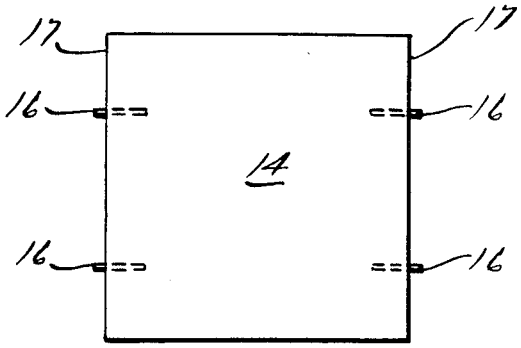
FIG. 5 is an elevational view of a wall member of the present invention.
Figure 6:
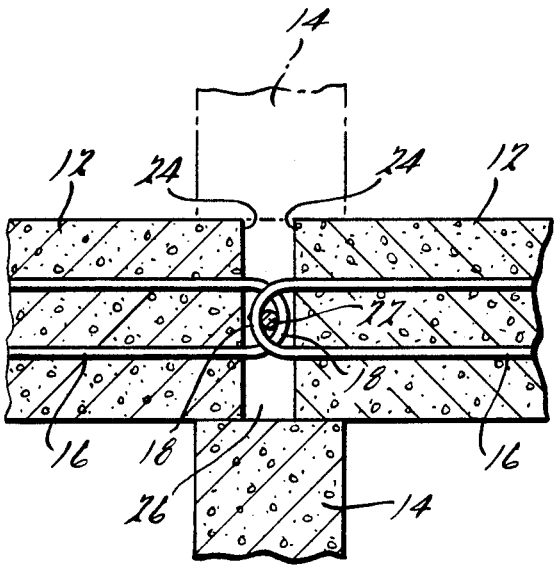
FIG. 6 is a cross sectional elevational view showing an embodiment of the present invention in which two hexagonal floor members are joined at a line of connection.

FIG. 3 is an enlarged view of the area designated with the numeral "3" in FIG. 2 that shows a typical hexagonal room or cell comprising the hexagonal member 12 and surrounding wall members 14. The method of tying adjacent hexagonal member 12 and adjacent wall member 14 together in their final configuration is shown in FIGS. 4 through 6. FIGS. 4 and 5 show hairpin or U-shaped reinforcing bars 16 cast into the vertical edges 17 of the precast wall member 14. The exposed portions of the U-shaped bars 16 form loops 18 that ultimately serve to tie the final structure together. A triangular space 20, shown in FIG. 4, is formed by the vertical edges 17 of the intersecting wall members 14. Into the triangular space 20 project the protruding loops 18 of the wall members 14. The loops 18 of the adjacent wall members overlap in the space 20 and a continuous reinforcing rod 22 is vertically inserted into the overlapped loops 18. After the rod 22 is in position, the space 20 is filled with grout to fix the loops 18 and the rod 22 in place. The hexagonal members 12 may also be provided with a vertical rod cast in their corners that will project into the triangular space 20 and be grouted in place to tie the hexagonal members 12 and the wall members 14 together.

When only two of the wall members 14 are to be tied together at their intersection, as in the case of two adjacent exterior wall members 14, the above method is followed except that the space to be filled with grout that is defined by the intersecting wall members 14 may not be triangular.

The hexagonal members 12 are connected to each other in a similar manner as shown in FIG. 6. The hexagonal members 12 have lateral edges 24. Cast into each of the lateral edges 24 are a pair of the U-shaped reinforcing bars 16 with the loops 18 protruding from the lateral edge 24. When the hexagonal members 12 are laid side by side, the loops 18 overlap in a slot 26 defined by the lateral edges 24. Through the overlapped loops 18 is inserted the reinforcing rod 22 and the slot 26 is thereafter filled with grout to fix the rod 22 and loops 18 in place. The size of the reinforcing bar or rod material that is used for the rods 22 and the U-shaped bars 16 may vary depending on various structural factors such as the size of the area to be grouted, thickness of the wall members 14 or the hexagonal members 12, and the like.

Figure 7:
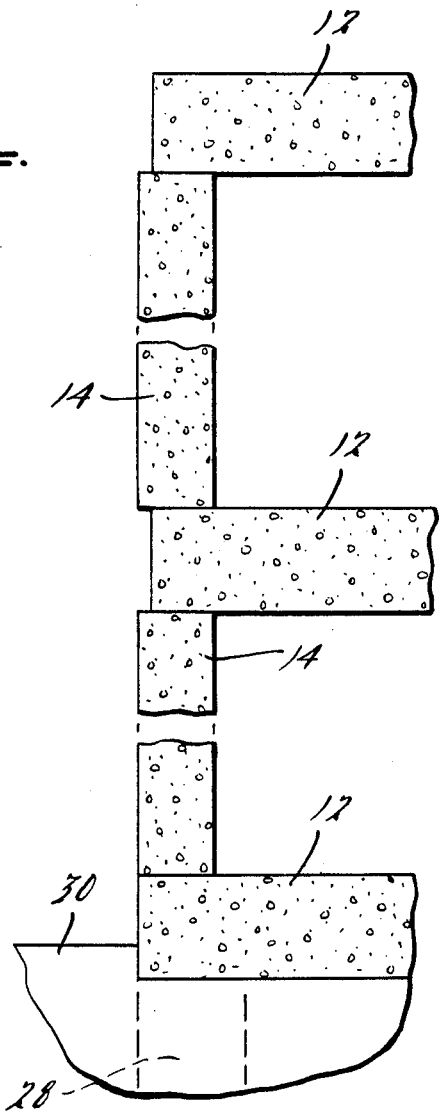
FIG. 7 is a cross sectional elevational view of an exterior wall of a multi-level building constructed in accordance with the present invention.

Preformed hexagonal members 12 may be placed at ground level (on grade) or the hexagonal ground level slab members may be formed from conventionally cast-in-place concrete. The hexagonal members 12 that are utilized at ground level may be required to be thicker in cross-section than the hexagonal members 12 that are utilized as ceiling members or intermediate floor members depending on local soil conditions and building code requirements. Such a ground level hexagonal member 12 is shown in FIG. 7 where the finished grade is shown at 30. The ground level hexagonal member 12 also may be provided with perimeter foundation walls 28 as required by local soil, climate, and building code provisions as shown in FIG. 7.

The value of the modular building construction system of the present invention is derived from the geometric configuration of its basic structural members. By using the hexagonal shape defined by the hexagonal members 12, when any lateral force such as seismic or other type loads are applied to the completed structure, such lateral forces are translated into axial forces in all the wall members 14. This translation of lateral forces into axial forces in the wall members 14 takes place because the lateral forces are broken into component vectors at each intersection of the wall members 14. The component vectors then act in axial compression on the respective contiguous wall members 14 thereby distributing such forces over a greater cross-sectional area and thus reducing shear stresses. Hence, a better overall resistance to such forces is provided than with the more conventional rectangular shaped modular systems in which such lateral forces can create shear stresses acting on only a portion of the wall members when such forces are normal to other walls in the structure.

The hexagonal geometric configuration of the hexagonal members 12 also distributes lateral forces or loads more evenly and throughout a larger area of horizontal floor or ceiling members due to the interlocking nature of the hexagonal shape than previously found in modular construction systems with rectangular floor and ceiling members. The hexagonal configuration of the present invention also transfers lateral or axial stresses in the floor slab members partially into a force or stress that is normal to the line of connection between two adjacent floor slab members. This conversion of axial stress into direct bearing stress upon the side of an adjacent hexagonal member is achieved by the breaking of the lateral force into its component vectors as dictated by the geometry of the hexagonal shape. The hexagonal shape inherently splits stresses due to the non-linear relative angulation of the joints between the hexagonal members. Consequently, the resultant force distribution closely approximates the distribution of stresses throughout a monolithic floor structure, but without the forming problems that are attendant to pouring in place such monolithic structures.

Accordingly, the present invention operates to provide a strong, efficient, and low cost modular construction assembly that utilizes two basic components to erect single or multiple room and level buildings.

While it is apparent that the preferred embodiments of the invention disclosed are well calculated to provide the advantages and features stated, it will be appreciated that the invention is susceptible to modification, variation, and change without departing from the proper scope and fair meaning of the subjoined claims.

What is claimed is:

1. A modular building construction system comprising a plurality of hexagonally shaped floor members adjacently laid in an interlocking relationship, a plurality of hexagonally shaped ceiling members, a plurality of rectangularly shaped wall members which have a length corresponding to one of the hexagonal sides of said floor members, said wall members being placed on the perimeters of said floor members to support the perimeters of said ceiling members, and a plurality of U-shaped rods embedded in the sides of said hexagonal floor and ceiling members and the vertical sides of said wall members so that a loop of said U-shaped rods is exposed, said loops serving to tie adjacent wall members and adjacent floor or ceiling members together by inserting a bar through the exposed loops that overlap when two or more wall members, or two floor or ceiling members, are abutted, wherein a longitudinal space is formed between said abutting vertical sides of said wall members and between said abutting sides of said ceiling or floor members, said longitudinal space being filled with grout after said bar is inserted through said overlapped loops, whereby horizontal forces applied to said hexagonally shaped floor or ceiling members are dispersed into the various lines of connection between said hexagonal floor or ceiling members.

2. A modular building construction system as described in claim 1, wherein said wall members may be provided with door or window openings.

3. A modular building construction system as described in claim 1, wherein the perimeter of said floor member sits on a foundation wall.

4. A modular building construction system as described in claim 1, wherein a plurality of said wall members sit on said ceiling members to support additional story ceiling members thereby forming a building of multiple stories.

5. A modular building construction system as described in claim 1, wherein said longitudinal space is triangular when three of said wall members meet at the intersection of three adjacent said floor members.

6. A modular building construction system as described in claim 5, wherein said floor and ceiling members contain bars vertically cast in the corners thereof, said vertical bars projecting into said triangular space between said wall members, thereby tying said wall members and said vertical sides of said ceiling member and said floor member together.

7. A modular building construction system as described in claim 1, wherein said hexagonal shape of said floor and ceiling member produces axial forces in said wall members when lateral forces are applied to said building.

8. A modular building construction system as described in claim 1, wherein one of said wall members is placed on the adjacent perimeter edges of two hexagonally shaped floor members.

* * * * *

UNITED STATES PATENT AND TRADEMARK OFFICE

CERTIFICATE OF CORRECTION

PATENT NO. : 4,546,583

DATED : October 15, 1985

INVENTOR(S) : Gary Hussar

It is certified that error appears in the above-identified patent and that said Letters Patent is hereby corrected as shown below:

Column 6, line 7, (Claim 6) after "between said" insert --vertical sides of said--.

Signed and Sealed this

*Twenty-third* Day of *September 1986*

[SEAL]

*Attest:*

DONALD J. QUIGG

*Attesting Officer*

*Commissioner of Patents and Trademarks*